US008436791B2

(12) United States Patent
Ota et al.

(10) Patent No.: US 8,436,791 B2
(45) Date of Patent: May 7, 2013

(54) LIGHT-EMITTING DEVICE AND MOBILITY COMPENSATING METHOD FOR DRIVING THE SAME, AND ELECTRONIC DEVICE

(75) Inventors: Hitoshi Ota, Shiojiri (JP); Satoshi Yatabe, Shiojiri (JP); Hideto Ishiguro, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 479 days.

(21) Appl. No.: 12/690,267

(22) Filed: Jan. 20, 2010

(65) Prior Publication Data

US 2010/0188377 A1 Jul. 29, 2010

(30) Foreign Application Priority Data

Jan. 26, 2009 (JP) ..... 2009-014223

(51) Int. Cl.
*G09G 3/30* (2006.01)

(52) U.S. Cl.
USPC ..... 345/78

(58) Field of Classification Search ..... 345/76, 345/78, 82
See application file for complete search history.

(56) References Cited

U.S. PATENT DOCUMENTS

| | | | | |
|---|---|---|---|---|
| 8,188,944 | B2 * | 5/2012 | Yamamoto et al. | 345/76 |
| 2007/0268210 | A1 | 11/2007 | Uchino et al. | |
| 2008/0001545 | A1 * | 1/2008 | Uchino et al. | 315/175 |
| 2008/0198104 | A1 * | 8/2008 | Yamashita et al. | 345/77 |
| 2009/0051628 | A1 * | 2/2009 | Kwon | 345/77 |
| 2009/0184903 | A1 * | 7/2009 | Kwon | 345/80 |
| 2010/0039421 | A1 * | 2/2010 | Toyomura et al. | 345/212 |

FOREIGN PATENT DOCUMENTS

| | | |
|---|---|---|
| JP | A-2007-310311 | 11/2007 |
| JP | A-2008-191296 | 8/2008 |
| JP | A-2008-256916 | 10/2008 |
| WO | WO/2008/123089 | * 10/2008 |

* cited by examiner

*Primary Examiner* — Chanh Nguyen
*Assistant Examiner* — John Kirkpatrick
(74) *Attorney, Agent, or Firm* — Oliff & Berridge, PLC

(57) ABSTRACT

A light-emitting device includes a light-emitting element that emits light of an amount based on the size of a driving current; a driving transistor, the gate thereof being electrically connected to a first node, that outputs a current flowing between the drain-source as the driving current; and a control unit that supplies a first data potential to the first node and supplies a current to the driving transistor so as to set the voltage between the gate and source of the driving transistor to a compensated voltage based on the mobility of the driving transistor, and then supplies a second data potential determined in accordance with the first data potential to the first node.

9 Claims, 8 Drawing Sheets

| | | | | | | |
|---|---|---|---|---|---|---|
| Tel[GEL] | OFF | ON | OFF | ON | OFF | ON |
| Tr1[GWRT] | OFF | OFF | ON | ON | ON | OFF |
| Tr2[GINI1] | ON | ON | OFF | OFF | OFF | OFF |
| Tr3[GINI2] | ON | OFF | OFF | OFF | OFF | OFF |

LIGHT-EMITTING DEVICE AND MOBILITY COMPENSATING METHOD FOR DRIVING THE SAME, AND ELECTRONIC DEVICE

This application claims priority to JP 2009-014223 filed in Japan on Jan. 26, 2009, the entire disclosure of which is hereby incorporated by reference in its entirety.

BACKGROUND

1. Technical Field

The present invention relates to a light-emitting device including an organic EL (electroluminescent) element and the like, a method for driving the same, and an electronic device.

2. Related Art

An OLED (organic light-emitting diode), or in other words, an organic EL element, is a thin and lightweight light emission source. Organic EL elements are structured so that at least one layer of organic thin film containing an organic compound is interposed between a pixel electrode and a counter electrode. The pixel electrode functions as, for example, an anode, while the counter electrode functions as a cathode. When an electric current flows between the pixel electrode and the counter electrode, electrons and electron holes recombine in the organic thin film, causing the organic thin film and organic EL element to emit light.

JP-A-2007-310311 (hereinafter referred to as Patent Document 1), JP-A-2008-191296 (hereinafter referred to as Patent Document 2), and JP-A-2008-256916 (hereinafter referred to as Patent Document 3) disclose examples of such organic EL elements and image display devices provided therewith.

Organic EL elements such as that described above are driven by a driving circuit that has an appropriate structure. Such a driving circuit is a circuit that supplies, to the organic EL element, the source-drain current of a driving transistor based on the gate potential thereof. In this case, the emission luminescence of the organic EL element can be adjusted and so on by adjusting the gate potential.

However, such driving circuits have various issues that need to be solved. As an example of such an issue, there is variance in various properties of driving transistors, such as the mobilities or threshold voltages thereof. An image display device such as that mentioned earlier is typically provided with multiple organic EL elements and a driving circuit including driving transistors associated with each of the organic elements. However, if the properties of the multiple driving transistors vary due to variance in various parameters during the manufacturing process and the like, variance will also arise in the adjustment and so on of the emission luminance of the organic EL elements. This interferes with improvements in the quality of the displayed image.

The aforementioned Patent Documents 1 to 3 disclose techniques for handling such a problem. While Patent Document 1 focuses upon "threshold voltage" and "mobility" ([0004] in Patent Document 1), Patent Document 2 considers primarily a "case where the optimal mobility correction time is short", and attempts to provide a technique for "suppressing variance in the luminance by making the variance in correction time relatively small" through the extension of the correction time, the correction time variance being caused by variance in the pulse widths of the input signal voltage write pulse ([0017], [0018] in Patent Document 2).

Patent Document 3 attempts to provide a technique for optimizing a mobility correction process "dependent on a video signal (driving signal, luminance signal) Vsig" ([0015] to [0017] of Patent Document 3).

According to these documents, certain effects can be achieved with respect to the aforementioned mobility variance. However, further issues still remain even if such mobility compensation ("correction" in the aforementioned documents) is carried out. For example, there is a problem that can be called the "tone dependence" of mobility compensation. That is to say, when performing mobility compensation according to a set time and a set procedure, there are cases where the mobility compensation operations can effectively suppress variance in the emission luminance when the organic EL element emits light of a certain specific tone, but may not suppress such variance when emitting light of other tones.

Furthermore, because restrictions may be placed on the amount of current supplied to organic EL elements in mobility compensation operations, there is the possibility that the operations cause difficulties in the realization of a desired emission luminance, and in particular, in the realization of a higher emission luminance.

More specifically, the aforementioned Patent Documents 1 to 3 disclose the techniques described hereinafter. Patent Document 1 discloses a technique for handling mobility variance by "adding correction for the mobility of a driving transistor to a signal voltage" for an "appropriate" amount of time in the gate of the driving transistor (claim 2 of Patent Document 1), in addition to correcting the threshold voltage (claim 1 of Patent Document 1). Patent Document 2 discloses a technique for "increasing the voltage value of the input signal voltage in stages" in order to so-called "precharge" the driving transistor in an early "stage", thereby reducing the gate-source voltage of that driving transistor and "increasing the optimum mobility correction time" (claim 1 and [0021] of Patent Document 2).

Although these techniques may be capable of solving the issues the aforementioned Patent Documents 1 and 2 focus upon, these techniques are not capable of effectively handling the aforementioned problems such as mobility correction tone dependence, restrictions on emission luminance, and so on.

Furthermore, Patent Document 3 discloses a technique for reducing "the influence of lows and highs in a video signal Vsig on the mobility correction process" by applying a "correction voltage", of "a value dependent on the video signal and lower than the video signal", to the gate of the driving transistor (claims 1 and [0035] of Patent Document 3).

Patent Document 3 may be relevant to the aforementioned mobility correction tone dependence problem, because a "correction voltage" "dependent on the video signal" is used (for example, see [0098] and on in Patent Document 3). However, in Patent Document 3, the "correction voltage" is applied using the time within what is known as the write interval of the video signal, and a light emission control transistor ("TEL_C" in Patent Document 3) that controls the conductive state between the source potential and the organic EL element being in an ON state at that time is a prerequisite (see, for example, FIG. 3, (C) in FIG. 6, and [0077] and on in Patent Document 3; see also the passage " . . . mobility correction process . . . that applies a voltage from a current supply unit to the source-drain area of one of the driving transistors" in claim 1). It can thus be said that this technique deals entirely with the gate-source voltage of the driving transistor that is to be achieved during mobility correction, or to put it differently, how the effectiveness within the concept of the so-called "mobility correction process" can be improved. Therefore, the technique of Patent Document 3, too, does not necessarily suitably solve the various problems "after" the aforementioned mobility correction.

SUMMARY

An advantage of some aspects of the invention is to provide a light-emitting device, method for driving the same, and electronic device capable of solving at least some of the aforementioned problems.

In addition, an advantage of some aspects of the invention is to provide a light-emitting device, method for driving the same, or electronic device capable of solving problems related to such a light-emitting device, method for driving the same, or electronic device.

In order to solve the aforementioned problems, a light-emitting device according to an aspect of the invention includes: a light-emitting element that emits light of an amount based on the size of a driving current; a driving transistor, the gate thereof being electrically connected to a first node, that outputs a current flowing between the drain and source as the driving current; and a control unit that supplies a first data potential to the first node and supplies a current to the driving transistor so as to set the voltage between the gate and source of the driving transistor to a compensated voltage based on the mobility of the driving transistor, and then supplies a second data potential determined in accordance with the first data potential to the first node.

According to an aspect of the invention, what is called mobility compensation is performed by supplying a first data potential to the gate of the first node, or in other words, the driving transistor, and supplying a current to the driving transistor. If it is assumed that there are two driving transistors with different mobilities, the respective gate-source voltages thereof match with respect to compensated voltages that differ in accordance therewith, and as a result, variance in the drain-source currents that flow in these two driving transistors is suppressed. However, this effect is generally achieved only when the light-emitting element emits light of a specific emission tone (or, more generally, an emission tone within a certain range), or in other words, only when a predetermined potential is supplied to the gate of the driving transistor. To rephrase, this means that the effects of the aforementioned mobility compensation cannot be achieved effectively with other emission tones and potentials.

According to an aspect of the invention, the second data potential is supplied to the first node after the mobility compensation has been performed. As a result, although the value of the gate-source voltage fluctuates, the second data potential in this case is "determined in accordance with the first data potential", which makes it possible to take appropriate measures with respect to the aforementioned emission tones and potentials with which the effects of the mobility compensation cannot be achieved. In other words, if the "potential" with which such mobility compensation effects cannot be achieved is the aforementioned first data potential, the second data potential can be determined based on, for example, "the degree to which the aforementioned mobility compensation effects according to such 'potential' cannot be achieved"; therefore, it is possible to suppress variance in the aforementioned drain-source current.

Based on the above, according to an aspect of the invention, it is possible to suppress variance in the emission luminance based on mobility variance, regardless of what emission tone the light-emitting element is emitting. In addition, according to an aspect of the invention, the second data potential is applied, thereby making it possible to increase the drain-source current, which makes it easier to realize a higher emission luminance or a brighter image display.

Note that the specific construction, materials, and so on of the "light-emitting element" referred to in the invention can basically be determined freely, and for example, an element in which a light-emitting layer composed of an organic EL compound or an inorganic EL compound is sandwiched between two electrodes can be employed as the light-emitting element of the invention. Furthermore, various light-emitting elements, such as an LED (Light-Emitting Diode) element, an element that emits light through plasma discharge, and so on can be used in the invention.

The light-emitting device according to an aspect of the invention may be configured so that the device further includes an emission control switching element, one end thereof being electrically connected to the drain of the driving transistor and the other end thereof being electrically connected to a source potential supply line, that switches between conductive and nonconductive states therebetween, and when the second data potential is supplied to the first node, the control unit sets the emission control switching element to an OFF state.

According to the aspect, the second data potential is supplied to the first node in a state where no current is supplied to the driving transistor (above mentioned "OFF state" refers to the state). As a result, in the aspect of the invention, appropriate measures can be taken with respect to problems that can arise due to carrying out mobility compensation (the two effects described earlier, or the suppression of variance in the emission luminance and the realization of a high emission luminance, can be called the evidence thereof). This point is a marked difference from the standpoint of the relationship with the aforementioned Patent Document 3. This aspect does not necessarily aim only to improve the effectiveness within the concept of the mobility compensation operation.

Note that in light of this aspect, the passage in the aforementioned definition of the invention that reads "a control unit that . . . then supplies a second data potential" can also be defined as "a control unit that then supplies a second data potential—without a current being supplied to the driving transistor—".

A light-emitting device according to an aspect of the invention may be configured so as to further include: a capacitance element, the two electrodes thereof being electrically connected to the gate and source, respectively, of the driving transistor, that holds the compensated voltage; a first switching element that switches between conductive and nonconductive states between the first node and supply lines of the first and second data potentials; a second switching element that switches between conductive and nonconductive states between the first node and the supply line of a predetermined fixed potential; and a third switching element that switches between conductive and nonconductive states between the source of the driving transistor and the supply line of a predetermined fixed potential.

According to the aspect, because the light-emitting device includes, for example, a third switching element, a driving circuit configuration for suitably driving the light-emitting device according to an aspect of the invention can be provided by realizing the initialization of the potential of the first node in a suitable manner, and so on. Note that details of a specific implementation of this aspect shall be described in the following embodiment.

A light-emitting device according to an aspect of the invention may be configured to include multiple light-emitting elements and multiple driving transistors corresponding respectively to each of the multiple light-emitting elements, and also determine the second data potential in accordance with the degree of variance in the mobilities of the driving transistors, in addition to the first data potential.

According to the aspect, the aforementioned effects of the invention can be achieved more effectively.

As described earlier, there are cases where the effects of performing the mobility compensation can only be achieved with a certain emission tone and potential. Such a phenomenon arises primarily due to variance in the mobilities of the driving transistors (refer to the descriptions of FIG. 4 or FIG. 7 in the following embodiment for details on this point). Therefore, it is clear that determining the second data potential taking into consideration such circumstances in addition to the size of the first data potential is more suitable for the purpose of achieving the effects of the invention. Note that it is even more suitable for the second data potential to be determined, for example, "so as to restrict variance in the drain-source current caused by variance in the mobilities of the driving transistors in the case where the first data potential is supplied to the first node", in order to further advance the effects of the invention.

A light-emitting device according to an aspect of the invention may be configured so as to further include a data table in which the second data potential, based on differences in the first data potential, is stored in advance.

According to the aspect, a data table in which the second data potential, based on differences in the first data potential, is stored in advance is provided, and therefore it is possible to realize a simplification and reduction in the processing time, a reduction in costs equivalent thereto, and so on, compared to, for example, an aspect in which the second data potential is directly calculated each time based on the first data potential.

In addition, in order to solve the aforementioned problems, an electronic device according to an aspect of the invention includes the aforementioned various light-emitting devices.

The electronic device according to an aspect of the invention includes the aforementioned various light-emitting devices, and thus is capable of suppressing variance in the emission luminance regardless of the emission tone that is being emitted, and is capable of realizing a higher emission luminance.

In order to solve the aforementioned problems, a method for driving a light-emitting device according to an aspect of the invention is the method including a light-emitting element that emits light of an amount based on the size of a driving current, the method including: supplying a first data potential to a first node connected to the gate of a driving transistor that outputs the driving current and supplying a current to the driving transistor so as to set the voltage between the gate and source of the driving transistor to a compensated voltage based on the mobility of the driving transistor; and supplying a second data potential determined in accordance with the first data potential to the first node after the supplying of the first data potential.

According to the aspect, it is clear that the same essential effects as the effects achieved by the light-emitting device of the aforementioned aspect of the invention can be achieved.

The method for driving a light-emitting device according to the aspect of the invention may be configured so that the light-emitting device further includes an emission control switching element, one end thereof being electrically connected to the drain of the driving transistor and the other end thereof being electrically connected to a source potential supply line, that switches between conductive and nonconductive states therebetween, and the supplying of the second data potential includes setting the emission control switching element to an OFF state.

According to the aspect, the same essential effects as the effects achieved by the aforementioned aspect of the light-emitting device of the invention that includes "an emission control switching element" can be achieved.

The method for driving a light-emitting device according to the aspect of the invention may be configured so that the light-emitting device includes multiple light-emitting elements and multiple driving transistors corresponding respectively to each of the multiple light-emitting elements, and also determines the second data potential in accordance with the degree of variance in the mobilities of the driving transistors, in addition to the first data potential.

According to the aspect, the same essential effects as the effects achieved by the aforementioned various aspects of the light-emitting device of the invention in which "the second data potential is also determined in accordance with the degree of variance in the mobilities of the driving transistors, in addition to the first data potential", can be achieved.

BRIEF DESCRIPTION OF THE DRAWINGS

The invention will be described with reference to the accompanying drawings, wherein like numbers reference like elements.

DETAILED DESCRIPTION OF EMBODIMENTS

Configuration of Organic EL Device

An embodiment of the invention will be described hereinafter with reference to FIGS. 1 and 2. Note that in addition to FIGS. 1 and 2 mentioned here, there are cases where, in the various drawings referred to hereinafter, the dimensional ratios of various elements differ as appropriate from the actual elements.

Figure 1:
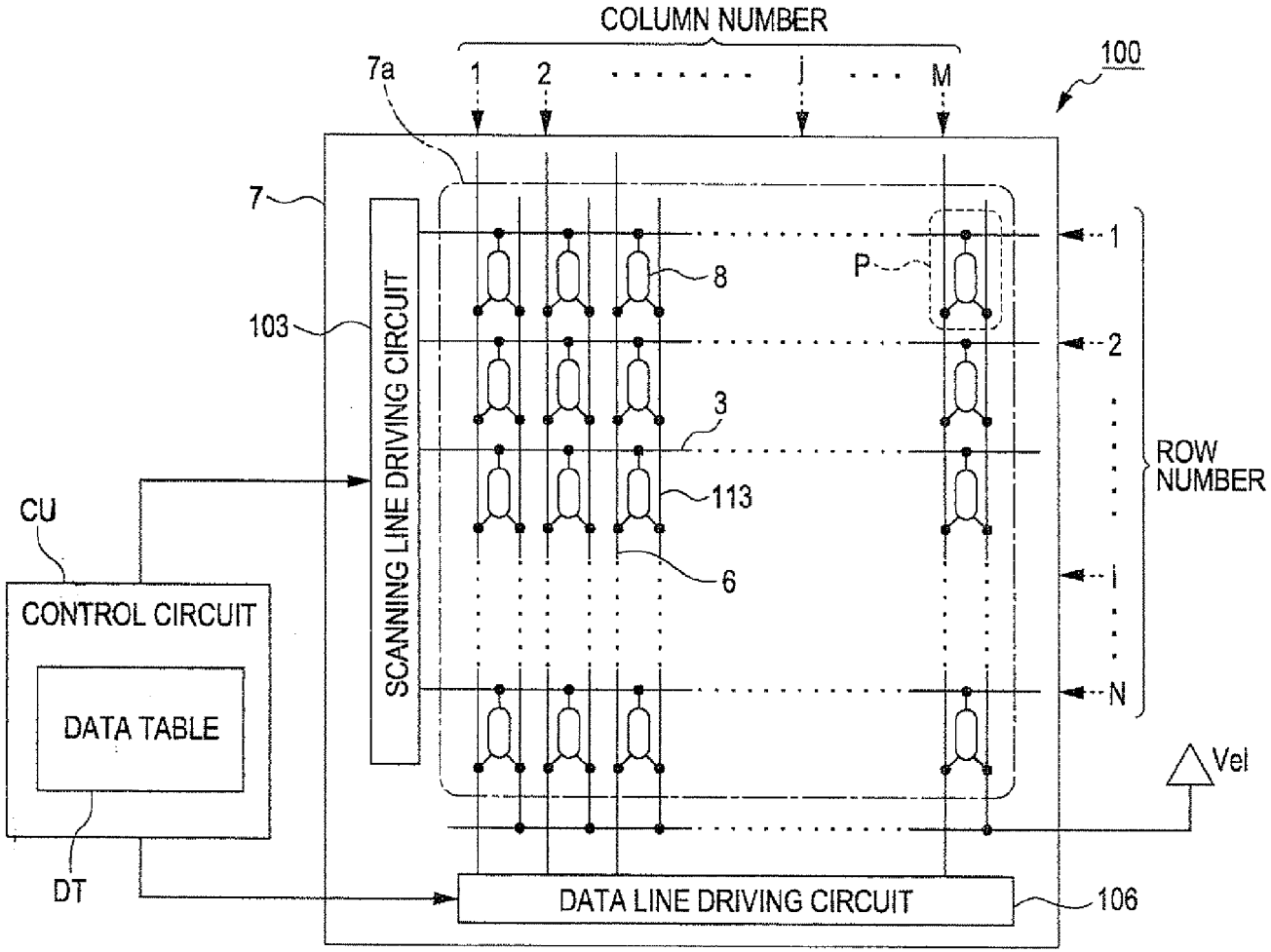
FIG. 1 is a block diagram illustrating an organic EL device according to an embodiment of the invention.

An organic EL device 100 includes, as shown in FIG. 1, an element substrate 7 and various elements formed upon the element substrate 7. The "various elements" are organic EL elements 8, scanning lines 3 and data lines 6, power source lines 113, a scanning line driving circuit 103, a data line driving circuit 106, and a control circuit CU.

As shown in FIG. 1, multiple organic EL elements (light-emitting elements) 8 are provided upon the element substrate 7. These multiple organic EL elements 8 are disposed in the form of a matrix having N rows and M columns (where N and M are natural numbers). Each of the organic EL elements 8 is composed of a pixel electrode serving as an anode, a light-emitting functional layer, and a counter electrode serving as a cathode.

An image display region 7*a* is the region upon the element substrate 7 in which the multiple organic EL elements 8 are disposed. A desired image can be displayed in the image display region 7*a* based on the individual organic EL elements 8 emitting or not emitting light. Note that the surface of the element substrate 7 excluding the image display region 7*a* is called the "peripheral region" hereinafter.

The scanning lines 3 and the data lines 6 are disposed so as to correspond to the rows and columns, respectively, of the organic EL elements 8 disposed as a matrix. To be more specific, as shown in FIG. 1, the scanning lines 3 extend in the left and right directions in the drawing, and are connected to the scanning line driving circuit 103 formed in the peripheral region. Meanwhile, the data lines 6 extend in the upper and lower directions in the drawing, and are connected to the data line driving circuit 106 formed in the peripheral region. Note that the power source lines 113 are disposed parallel to the data lines 6. A high source potential Vel is supplied to the power source lines 113.

Of the aforementioned circuits, the scanning line driving circuit 103 is a circuit for selecting the respective scanning lines 3 in order. Meanwhile, the data line driving circuit 106 is a circuit for supplying a data signal over the data lines 6 to the respective organic EL elements 8 that correspond to the scanning lines 3 selected by the scanning line driving circuit 103.

The control circuit CU controls the scanning line driving circuit 103 and the data line driving circuit 106, and determines the selection order of the scanning lines 3, the timing at which to supply data signals, or the like. Note that this control circuit CU includes a data table DT, as shown in FIG. 1. This data table DT relates to an offset voltage Voffset, described later, and thus descriptions thereof will be mentioned later.

A unit circuit (pixel circuit) P containing the aforementioned organic EL element 8 and so on is provided in the vicinity of each point at which a scanning line 3 and a data line 6 intersects.

Figure 2:
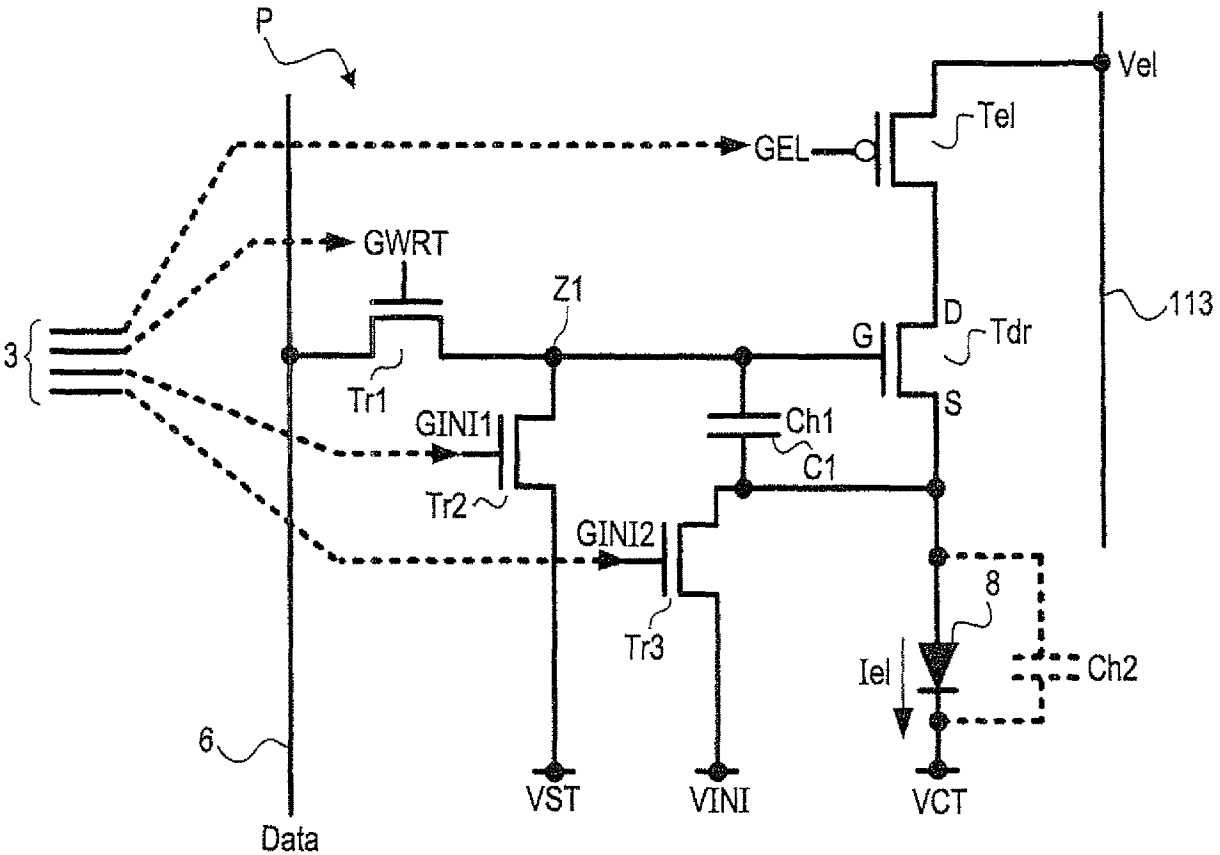
FIG. 2 is a circuit diagram illustrating the details of a unit circuit included in the organic EL device.

As shown in FIG. 2, in addition to containing the organic EL element 8, each unit circuit P contains a driving transistor Tdr, a light emission control transistor Tel, first through third transistors Tr1 to Tr3, and a capacitance element C1.

Note that the scanning line 3, which is shown in FIG. 1 as being a single line for the sake of simplicity, actually includes four lines, as shown in FIG. 2. A predetermined signal is supplied to each line from the scanning line driving circuit 103. To be more specific, a scanning signal GWRT[i], a first compensation control signal GINI1[*i*], a second composition control signal GINI2[*i*], and an emission control signal GEL [i] are supplied to the respective lines. The specific meanings of each of the signals, the operations of the unit circuit P in response thereto, and so on will be described later. Note that the symbol "i" used here refers to the row number within the matrix-form arrangement (see FIG. 1). Because a single scanning line 3 is composed of four lines, the number of lines contained in all the scanning lines 3 is ultimately 4N lines.

The driving transistor Tdr is an n-channel type, and is located on the path from the power source line 113 to the pixel electrode of the organic EL element 8. The drain (D) of the driving transistor Tdr is connected to the source of the emission control transistor Tel.

The driving transistor Tdr is a unit that, by changing the conductive state between the source (S) and the drain (D) (the source-drain resistance value) based on a gate potential Vg, generates a driving current Iel based on the gate potential Vg. Note that the gate potential Vg depends on the size of a data signal Data supplied over the data line 6.

In this manner, the organic EL element 8 is driven based on the conductive state of the driving transistor Tdr and the data signal Data.

The emission control transistor Tel is a p-channel type, and is located between the driving transistor Tdr and the power source line 113. The aforementioned emission control signal GEL[i] is supplied to the gate of the emission control transistor Tel. When the emission control signal GEL[i] transits to low-level, the emission control transistor Tel enters an ON state, making it possible to supply the driving current Iel to the organic EL element 8. Accordingly, the organic EL element 8 emits light of a tone (luminance) in accordance with the driving current Iel. As opposed to this, when the emission control signal GEL[i] is high-level, the emission control transistor Tel is kept in an OFF state, obstructing the path of the driving current Iel and extinguishing the organic EL element 8.

Note that the pixel electrode of the organic EL element 8 is connected via the emission control transistor Tel and the driving transistor Tdr to the power source line 113 on which the high power source potential Vel is supplied, and the counter electrode thereof is connected to a potential line (not shown) to which a low power source potential VCT is supplied.

The capacitance element C1 is an element in which a dielectric is inserted between two electrodes. The capacitance value thereof is Ch1. One of the electrodes of this capacitance element C1 (the upper electrode in FIG. 2) is connected to the gate of the driving transistor Tdr. Meanwhile, the other electrode of the capacitance element C1 (the lower electrode in FIG. 2) is connected to the source (S) of the driving transistor Tdr, and is also connected to the source or drain of a third transistor Tr3, which will be mentioned later.

The first transistor Tr1 is a switching element located between a node Z1 and the data line 6, and controls the electrical connection therebetween. The aforementioned scanning signal GWRT[i] is supplied to the gate of the first transistor Tr1.

The second transistor Tr2 is a switching element provided between the node Z1 and a potential line on which an initial potential VINI is supplied, and controls the electrical connection therebetween. The aforementioned first compensation control signal GINI1[*i*] is supplied to the gate of the second transistor Tr2.

The third transistor Tr3 is a switching element provided between the aforementioned potential line of the low power source potential VST and the source of the driving transistor Tdr, and controls the electrical connection therebetween. The aforementioned second compensation control signal GINI2[*i*] is supplied to the gate of the third transistor Tr3.

Figure 3:
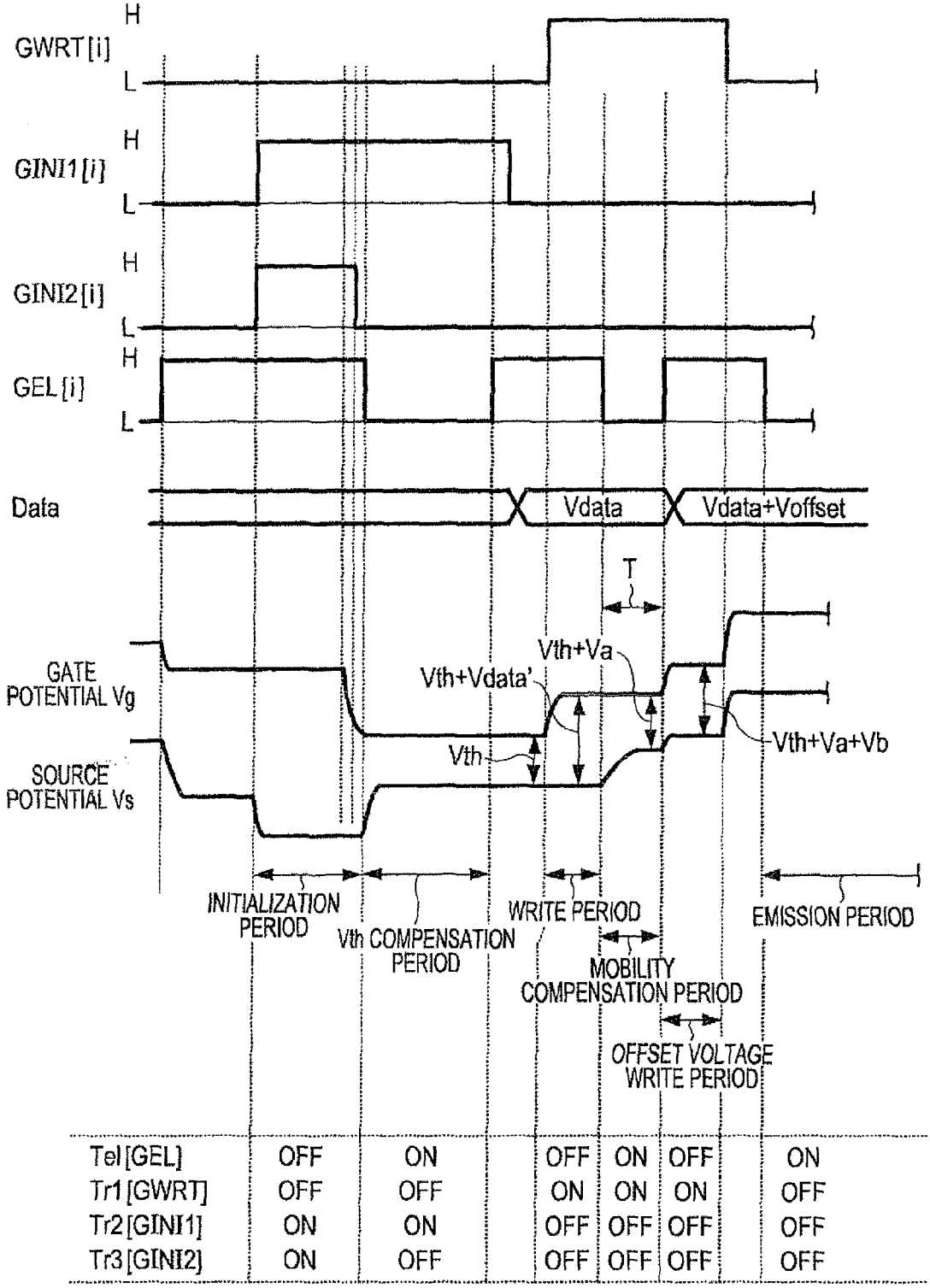
FIG. 3 is a timing chart illustrating operations of the unit circuit of FIG. 2.

Next, the operations and effects of the organic EL device 100 configured as described above will be described with reference to FIG. 3 in addition to the already-referenced FIG. 1 and FIG. 2.

i. Initialization: First, the first compensation control signal GINI1[*i*] and the second compensation control signal GINI2[*i*] are set to high-level, thereby putting the second transistor Tr2 and the third transistor Tr3 in an ON state. Accordingly, the gate potential Vg and source potential Vs of the driving transistor Tdr drop as shown in FIG. 3, resulting in the initial potential VST and VINI.

Note that the unit circuit P performs each of the operations from the initialization (i) mentioned here to the driving (vi) mentioned later repeatedly. The initialization operation (i) is performed after the final driving operation (vi) (light emission operation) has ended, or in other words, after the emission control signal GEL[i] has transited from low-level to high-level. The drops of both the gate potential Vg and the source potential Vs prior to the drop of the source potential Vs on the leftmost side of FIG. 3 corresponds to such a transit of the emission control signal GEL[i].

ii. Vth Compensation: Next, the second compensation control signal GINI2[*i*] transits to low-level, and furthermore, the emission control signal GEL[i] then transits to low-level as well. Accordingly, the third transistor Tr3 enters an OFF state, and furthermore, the emission control transistor Tel then enters an ON state. This causes the source potential Vs to be released from the supply of the initialization potential VST. As a result, with the driving transistor Tdr and the high power source potential Vel entering a conductive state, the source potential Vs of the driving transistor Tdr begins to rise, as shown in FIG. 3, and the gate-source voltage thereof asymptotically approaches the threshold voltage Vth. Note that during this series of processes, the capacitance element C1 connected between the gate and source of the driving transistor Tdr holds the threshold voltage Vth (in other words, the capacitance element C1 holds an appropriate voltage according to each of the operations that follow thereafter as well).

As described above, in the operations in (ii), compensation is performed on the threshold voltages Vth in each driving transistor Tdr.

iii. Data Writing: Next, the emission control signal GEL[i] and the first compensation control signal GINI1[*i*] transit to high-level and low-level, respectively, and the emission control transistor Tel and second transistor Tr2 enter an OFF state as a result; on the other hand, the scanning signal GWRT[i] transits to high-level, and thus the first transistor Tr1 enters an ON state. At this time, a data signal having an appropriate data potential Vdata is supplied over the data line 6, and as a result, the potential of the node Z1, or in other words, the gate potential Vg, fluctuates by a voltage equivalent to the amount of the added data potential Vdata. Therefore, the gate-source voltage of the driving transistor Tdr becomes, as shown in FIG. 3, Vth+Vdata'. Here, Vdata'=Vdata·(Ch2/(Ch2+Ch1)). Ch2 in this equation is the value of the parasitic capacitance of the organic EL element 8.

iv. Mobility Compensation: Next, the emission control signal GEL[i] transits to low-level while the scanning signal GWRT[i] is held at high-level. Accordingly, the emission control transistor Tel once again enters an ON state, and thus the source potential Vs of the driving transistor Tdr begins to rise. In FIG. 3, the gate-source voltage is expressed as becoming Vth+Va following the rise of the source potential Vs, but this means that the amount of the rise of the source potential Vs can be expressed as "Vdata'−Va". As a result, the gate-source voltage of the driving transistor Tdr actually decreases (if the amount of the drop is taken as α, α=Vdata'−Va).

The degree of such a rise in the source potential Vs and a drop in the gate-source voltage thus generally differs due to each of the driving transistors Tdr contained in each unit circuit P having differing mobility properties. In other words, qualitatively speaking, with a driving transistor Tdr having a higher mobility μ, the amount of rise in the source potential Vs is greater, whereas with a driving transistor Tdr having a lower mobility μ, the amount of rise in the source potential Vs is lower.

As described above, in the operations in (iv), mobility compensation is performed for each driving transistor Tdr.

v. Offset Voltage Writing: Next, the emission control signal GEL[i] transits to high-level while the scanning signal GWRT[i] is held further at high-level. Accordingly, the emission control transistor Tel once again enters an OFF state. At this time, a data signal having a potential in which an offset voltage Voffset based on the size of the aforementioned data potential Vdata has been added to the data potential Vdata (in other words, Vdata+Voffset (see FIG. 3) is supplied over the data line 6. The potential of the node Z1, or in other words, the gate potential Vg fluctuates in response thereto, by an amount equivalent to the added offset voltage Voffset. Although both the gate potential Vg and the source potential Vs rise at this time, due to this fluctuation, the gate-source voltage of the driving transistor Tdr is expressed as ultimately becoming Vth+Va+Vb (FIG. 3). The value of Vb is determined by the influence of the capacitance element C1 and the parasitic capacitance of the organic EL element 8 (see the broken line in FIG. 3), and to be more specific, Vb=Voffset×(Ch2/(Ch1+Ch2)). Here, Ch2 is the aforementioned value of the parasitic capacitance.

Note that how the offset voltage Voffset is determined, or the meaning, influence, and effects thereof, will be described again later.

vi. Driving: Whereas the scanning signal GWRT[i] transits to low-level and the first transistor Tr1 enters an OFF state, the emission control signal GEL[i] transits to low-level for the third time, and the emission control transistor Tel enters an ON state. Accordingly, a driving current Iel of a size based on the gate potential Vg is supplied from the driving transistor Tdr to the organic EL element 8, and the organic EL element 8 emits light.

Next, details of the aforementioned offset voltage Voffset will be given with reference to the drawings following FIG. 4, in addition to FIGS. 1 through 3 referred to already.

It is suitable for the offset voltage Voffset to be determined in the manner described hereinafter.

Figure 4:
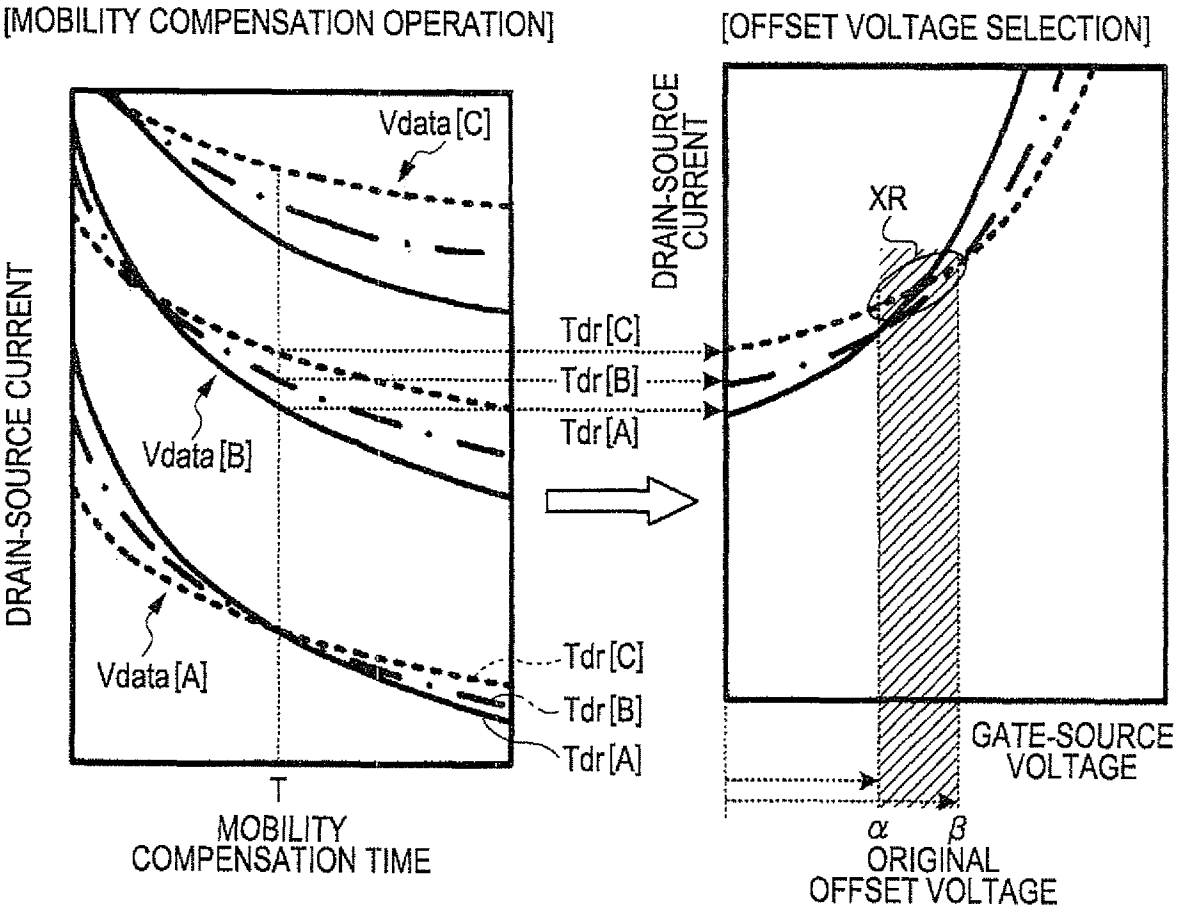
FIG. 4 is a diagram illustrating how an offset voltage Voffset is determined.
Figure 5:
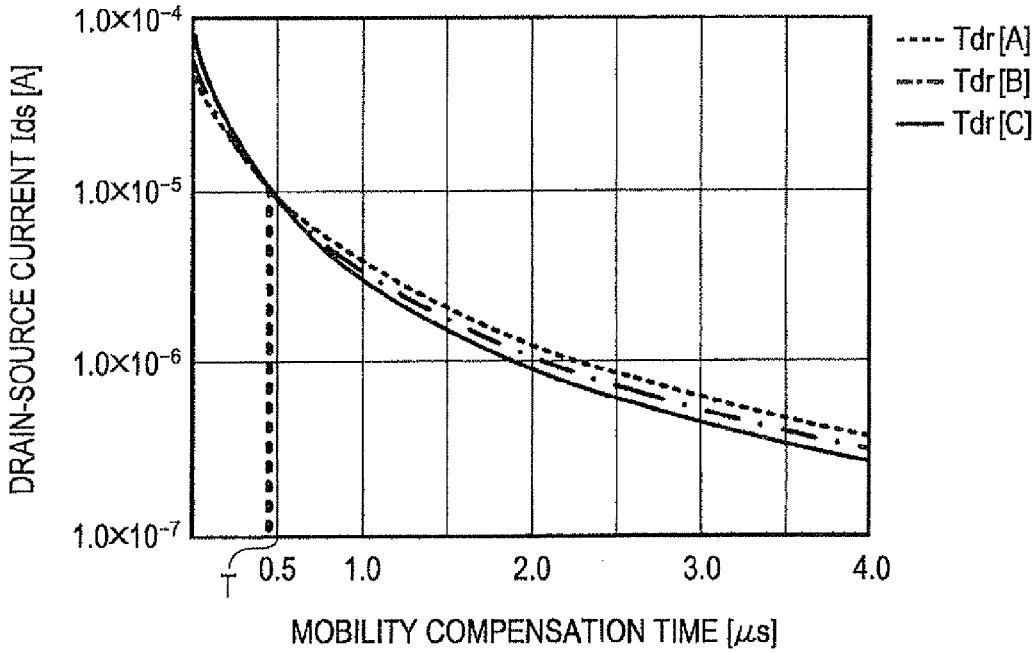
FIG. 5 is a graph illustrating the state of change in the drain-source current of a driving transistor relative to the amount of time a mobility compensation operation is executed ((the mobilities of) driving transistors Tdr[A] to Tdr[C] having different mobilities are the parameters).

First, as shown on the left side of FIG. 4 and particularly in FIG. 5, the mobility compensation operations on the aforementioned (iv) are carried out over a predetermined amount of time T (in FIGS. 4 and 5, the "mobility compensation time") (see FIG. 3 as well). The length of this mobility compensation time is determined by various circumstances including circumstances related to the device as a whole, but as shown in FIG. 5, is generally determined based on the relationship between the mobility compensation execution time and the drain-source current Ids of the driving transistor Tdr, and the relationship between above mentioned relationship and the variance of the mobility in each driving transistor Tdr included in each unit circuit P. FIG. 5 illustrates a state where when the mobility properties degrade based on the order of the driving transistors Tdr (A) to Tdr (C), the optimum mobility compensation time T (called the "optimum compensation time T" hereinafter) is determined in the vicinity of the point where all the curves of the driving transistors Tdr(A) to Tdr(C) intersect, at 0.5 μs. Note that there are cases where the mobility of the driving transistor Tdr(A) in FIG. 5 (the solid line) has a variance of ±20% relative to the respective mobilities. In other words, taking 1.0 as the standard, properties with a 20% higher mobility are 1.2, whereas properties with a 20% lower mobility are 0.8.

Figure 6:
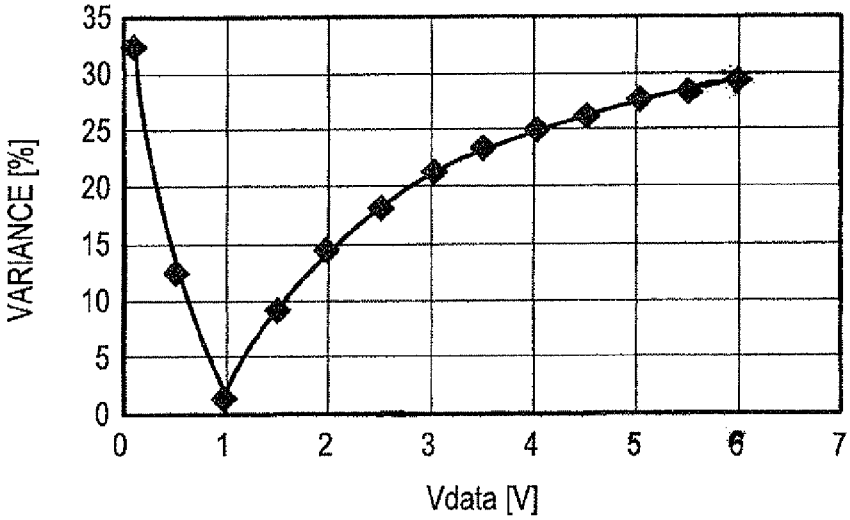
FIG. 6 is a graph illustrating the state of change in the degree of emission luminance variance relative to a data potential.

Executing the mobility compensation across such an optimum compensation time T does suppress variance in the emission luminance caused by mobility variance in the driving transistors Tdr. However, this only applies to specific light emission tones. FIG. 6 illustrates such a condition. That is, FIG. 6 illustrates a situation where when mobility compensation is carried out for the optimum compensation time T, the variance can be suppressed extremely effectively when the data potential Vdata=1 (V) (that is, when the organic EL element 8 emits light of an emission tone occurring when a driving current Iel corresponding to this data potential 1 (V) flows through the organic EL element 8), whereas when the data potential Vdata is a different value, the degree of variance suppression degrades. Note that the "variance" on the vertical axis of FIG. 6 is determined based on the ratio between the minimum/maximum values of the emission luminance.

Such a situation is also illustrated on the left side of FIG. 4. In other words, FIG. 4 illustrates a situation where when the data potential is Vdata (A) during optimum compensation time T, variance in the drain-source current Ids is effectively suppressed, whereas the optimum mobility compensation time in the case where the data potential is Vdata (B) is shifted to the left in FIG. 4 compared to the data potential Vdata (A), and as a result, no particular suppression effects are achieved with respect to the variance in the optimum compensation time T. As is clear from the drawings, such effects are primarily caused by variance in the mobility of the driving transistors Tdr. Note that "Tdr(A)", "Tdr(B)", and "Tdr(C)" in these drawings express, as with FIG. 5, highs and lows in the mobilities for the different driving transistors Tdr.

In such a state, the mobility compensation effects can only be achieved when the organic EL element 8 emits light of a certain tone.

Accordingly, the offset voltage Voffset is determined in the manner indicated on the right side of FIG. 4.

The right side of FIG. 4 indicates, with respect to each driving transistor Tdr in the case of the data potential Vdata (B), in what manner the drain-source currents will change when the gate-source voltages of the driving transistors Tdr are changed. As shown in FIG. 4, the driving transistor Tdr (A), which has a higher mobility, increases the drain-source current Ids relatively and suddenly following a rise in the gate-source voltage. In contrast, the driving transistor Tdr(C), which has a lower mobility, has a relatively subdued degree of increase in the drain-source current Ids. Therefore, the curves traced within a space indicated in the right side of FIG. 4 by driving transistors Tdr that have such different mobilities will, when the gate-source voltage takes on a certain value, approach at a constant degree, or will approach one another so as to fall within the range of a set region XR. Note that although the right side of FIG. 7 has similar content to that of FIG. 4, it is shown more accurately and with more detail (FIG. 7 corresponds to FIG. 5 in the same manner that the right side of FIG. 4 corresponds to the left side of FIG. 4).

Figure 7:
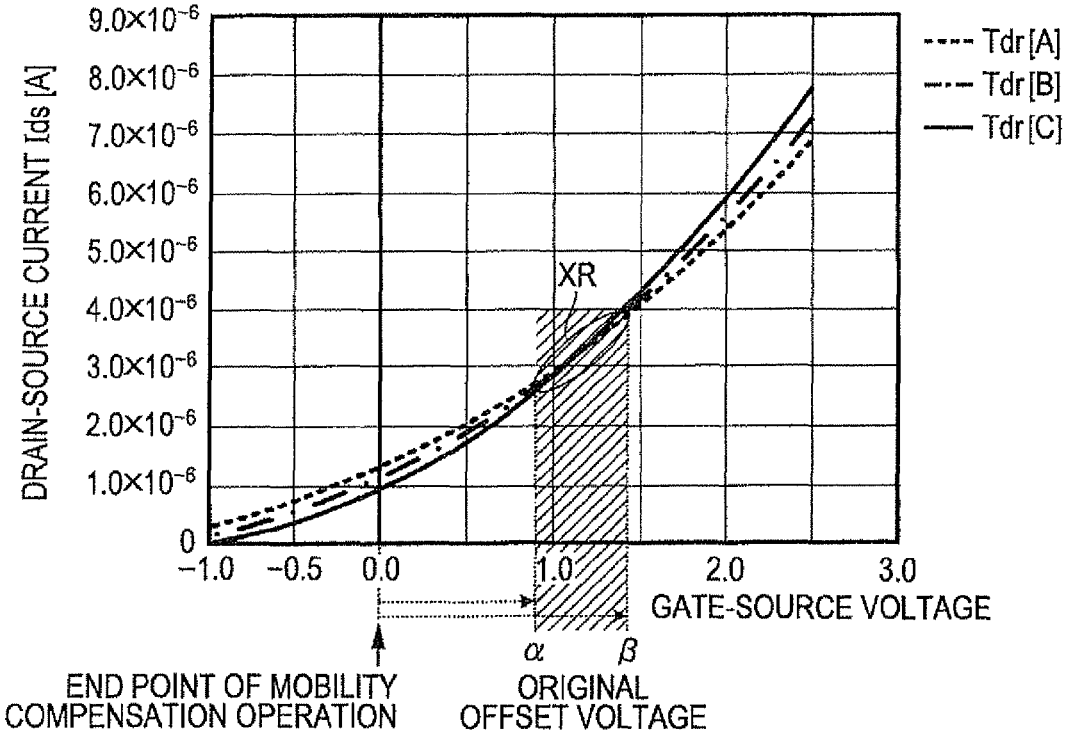
FIG. 7 is a graph illustrating the state of change in the drain-source current relative to the gate-source voltage of a driving transistor ((the mobilities of) driving transistors Tdr [A] to Tdr[C] having different mobilities are the parameters).

The offset voltage Voffset is determined taking into consideration the existence of a region XR such as that indicated in FIG. 4 or FIG. 7.

In other words, in the cases indicated in these drawings, a particularly suitable original offset voltage Voffset' (this refers to a voltage used as a standard when determining the offset voltage Voffset) can be obtained by determining a value within a range between a gate-source voltage α, which is determined based on the point where the curves for the driving transistors Tdr(A) and Tdr(B) intersect, and a gate-source voltage β, which is determined based on the point where the curves for the driving transistors Tdr(B) and Tdr(C) intersect. If the original offset voltage Voffset' is determined in such a manner, suitable mobility compensation effects can be attained even in the case where the data potential is Vdata (B).

Note that FIGS. 4 and 7 are designed particularly to simplify descriptions, and thus assume a case where the relationship between the curves traced by the driving transistors Tdr(A) to Tdr(C) are extremely simple curves; hence the aforementioned descriptions discuss an example in which the setting of the region XR based on "intersection points" of the curves, and the setting of the original offset voltage Voffset', are comparatively easy to perform. However, the invention is not limited to such a form.

Practically, an extremely large number of driving transistors Tdr are involved, and there are cases where the mobility properties or variance situations of those many driving transistors Tdr are not constant. Furthermore, it is easy to conceive of a situation where more than two types of data potential Vdata are involved, and it is also necessary to consider the influence of the existence of multiple data potentials.

Therefore, various setting methods may be used when setting the region XR as shown on the right side of FIG. 4 or FIG. 7, such as setting the region XR by employing a graphical/geometrical method instead of using the aforementioned "intersection points", or simply determining an appropriate numerical value for the degree of suppression in the variance of the drain-source current (or the variance in the emission luminance) that is to be suppressed and setting the region XR using that numerical value as a primary reference. Essentially, any setting method falls within the scope of the invention.

Note that the passage "the second data voltage . . . is also determined in accordance with the degree of variance in the mobilities of each of the driving transistors" mentioned in the invention comprehensively includes situations where the original offset voltage Voffset' is set based upon the aforementioned setting methods using the region XR as well as other types of setting methods.

The offset voltage Voffset used in the aforementioned offset voltage write operation (v) is determined based on the original offset voltage Voffset' determined as described above. At that time, as already mentioned, the existence of the capacitance element C1 and the parasitic capacitance of the organic EL element 8 are taken into consideration.

A more important factor is considerations with respect to differences in the data potential Vdata. As illustrated on the left side of FIG. 4 earlier, if the data potential takes on a value of Vdata (C) and so on, different from Vdata (A) and Vdata (B), the degree of variance in the driving transistors Tdr during the optimum compensation time T differs, and at the same time, the shapes on the right side of FIG. 4 (this point is not shown in FIG. 4) also differ. Therefore, in this case, the value of the original offset voltage Voffset' itself changes and thus the offset voltage Voffset is determined based thereupon. In other words, as already described with respect to the aforementioned offset voltage write operation (v), the offset voltage Voffset depends on the size of the data potential Vdata during the aforementioned data write period (iii).

The offset voltage Voffset ultimately determined is therefore determined having taken into consideration the various types of factors described hereinbefore.

Figure 8:
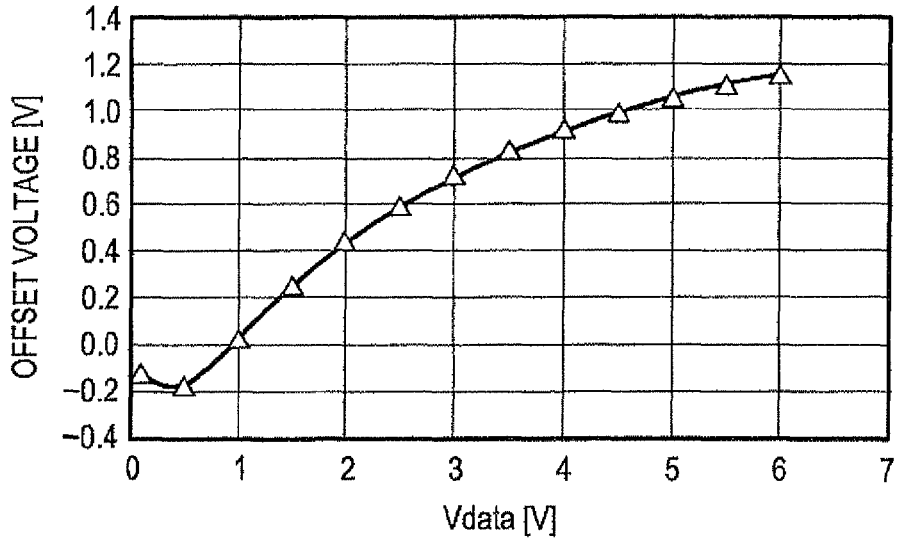
FIG. 8 is a graph illustrating examples of settings for suitable offset voltages corresponding to individual data potentials.

FIG. 8 illustrates an example of the offset voltage Voffset determined as described thus far. In FIG. 8, a data potential Vdata of 1 (V) is taken as one type of standard (in this case, Voffset=0; see FIG. 6), and it can be seen that various settings are made, so that, for example, when the data potential Vdata=3 (V), the offset voltage Voffset is approximately 0.7 (V); when Vdata=6 (V), the offset voltage Voffset is approximately 1.15 (V); and so on.

According to FIG. 8, it can be generally understood that, when the data potential Vdata during the data write operation (iii) is greater than or equal to a predetermined value, it is desirable for the potential of the data signal during the offset voltage write operation (v) to have a greater value than the data potential Vdata (that is, Vdata+Voffset>Vdata), or, when the data potential Vdata is less than the predetermined value, it is desirable for the potential of the data signal to have a lower value than the data potential Vdata (that is, Vdata+Voffset<Vdata). It goes without saying that this "predetermined value" refers to, in FIG. 8, "1 (V)", but of course the invention is not limited thereto. More generally speaking, the "predetermined value" is related to the aforementioned optimum compensation time T (or, assuming that the length of the mobility compensation time secured (or actually executed) during the aforementioned mobility compensation operation (iv) is determined in advance, it may be said that the emission tone in which the mobility compensation effects are realized to the maximum extent is determined by that length, and thus the "predetermined value" is related to the emission tone).

The final Voffset (of, generally speaking, multiple types) determined in this manner is stored in the aforementioned data table DT (see FIG. 1) in accordance with differences in the aforementioned data potential Vdata. In the execution of the aforementioned offset voltage write operation (v), the control circuit CU refers to the value of the data potential Vdata applied in the data write operation (iii) executed immediately prior thereto, uses the offset voltage Voffset corresponding thereto from the data table DT, and executes the offset voltage write operation.

The following effects can be achieved with the organic EL device 100 and unit circuit P as described above.

Figure 9:
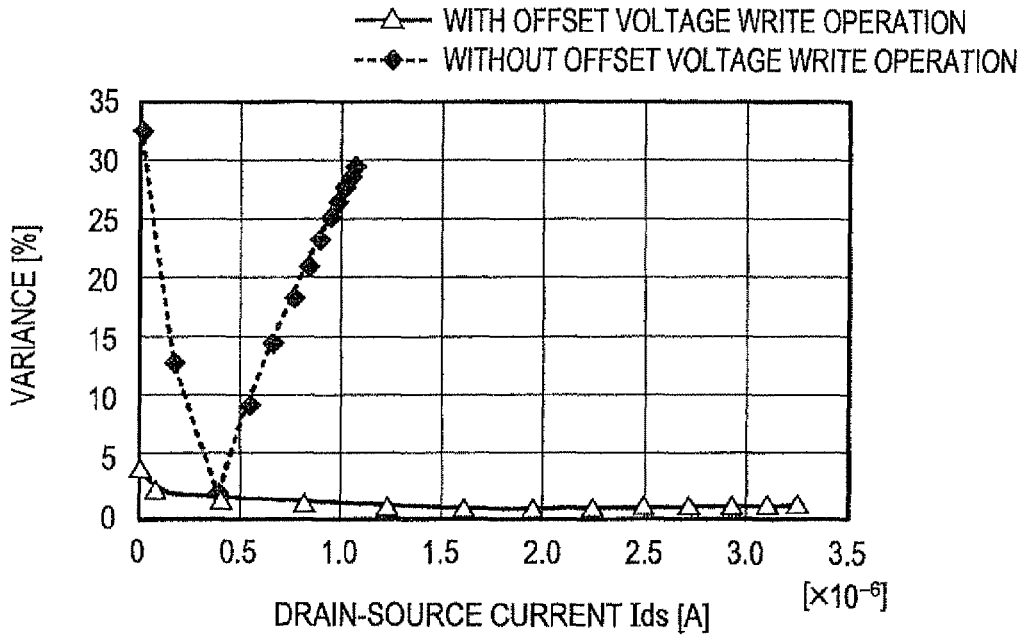
FIG. 9 is a graph illustrating the state of change in emission luminance variance relative to drain-source current following the execution of mobility compensation and the application of offset voltage (two examples, where offset voltage write operations do and do not occur, are shown).

1. According to the unit circuit P of the embodiment, an offset voltage Voffset determined in accordance with differences in a data potential Vdata is applied to the gate-source voltage of a driving transistor Tdr following a mobility compensation operation, and thus the degree of variance in the emission luminance, caused by mobility variance, can be suppressed, regardless of the tone that the organic EL element 8 is emitting. FIG. 9 indicates the degree to which the variance can be suppressed, and as can be seen in FIG. 9, a much higher degree of variance suppression is possible in the case where there is an offset voltage write operation, as opposed to when there is no offset voltage write operation.

2. According to the unit circuit P of the embodiment, it is possible to realize a higher emission luminance. As is indicated in, for example, FIG. 5, the drain-source current Ids of the driving transistors Tdr (A) to Tdr (C) will drop when the mobility compensation is executed (in FIG. 5, although a current of approximately $1.0\times10^{-4}$ (A) will originally flow, a current of only approximately $1.0\times10^{-5}$ (A) will flow as a result of mobility compensation operations for the optimum compensation time T). Therefore, there is the possibility that it will be difficult to realize a higher emission luminance or a brighter image display.

Figure 10:
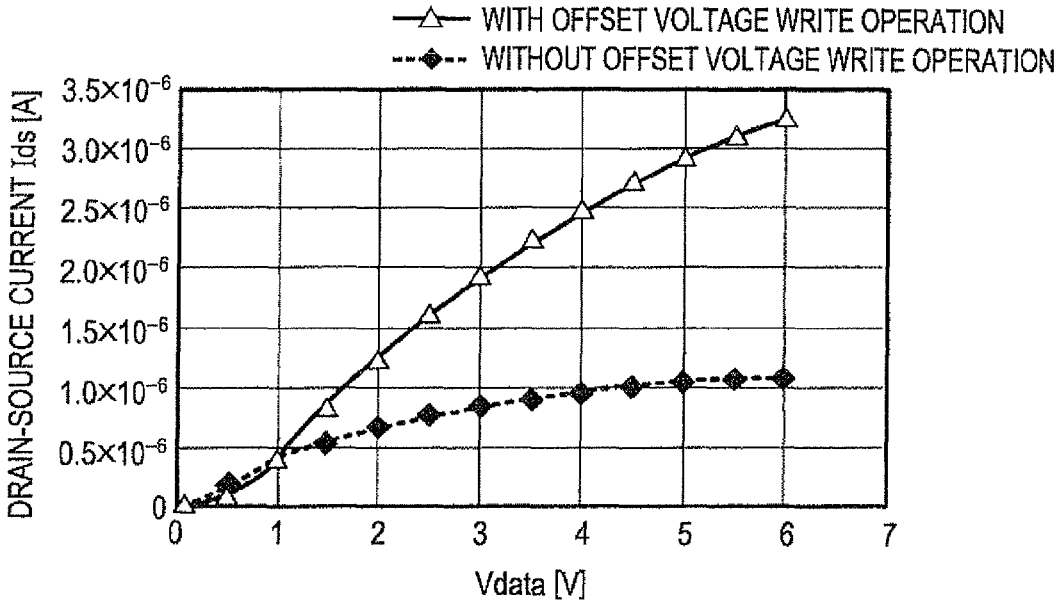
FIG. 10 is a graph illustrating the state of change in drain-source current relative to the data potential following the execution of mobility compensation and the application of offset voltage (two examples, where offset voltage write operations do and do not occur, are shown).

Accordingly, in the embodiment, the offset voltage Voffset is applied after the execution of such a mobility compensation operation, and thus the so-called recovery of a certain amount of current is possible. In other words, as can be seen on the right side of FIG. 4 and the vertical axis of FIG. 7, the amount of current flowing to the organic EL element 8 increases (that is, the emission luminance increases) due to the application of the offset voltage Voffset. FIG. 10 illustrates the degree of current increase effects (that is, the emission luminance increase effects) obtained assuming the case illustrated in FIG. 9, and as can be seen in FIG. 10, the drain-source current Ids may increase greatly in the case where there is an offset voltage write operation, as opposed to the case where there is no offset voltage write operation.

3. According to the unit circuit P of the embodiment, the aforementioned offset voltage write operation (v) is carried out with the emission control transistor Tel in the OFF state, or in other words, the mobility compensation operation (iv) and the offset voltage write operation (v) are performed independently of one another. In other words, the application of the offset voltage Voffset in the embodiment is not necessarily carried out with the purpose of ensuring the effectiveness of the mobility compensation operation, and rather is carried out with the purpose of rectifying problems that may arise due to mobility compensation process (the two effects described in the aforementioned 1 and 2 can be called the evidence thereof). This point in particular is the most marked difference of the embodiment from the standpoint of the relationship with the aforementioned Patent Document 3, in terms of the configuration, influence, and effects.

Application

Next, electronic devices in which the organic EL device 100 according to the above embodiment has been applied will be described.

Figure 11:
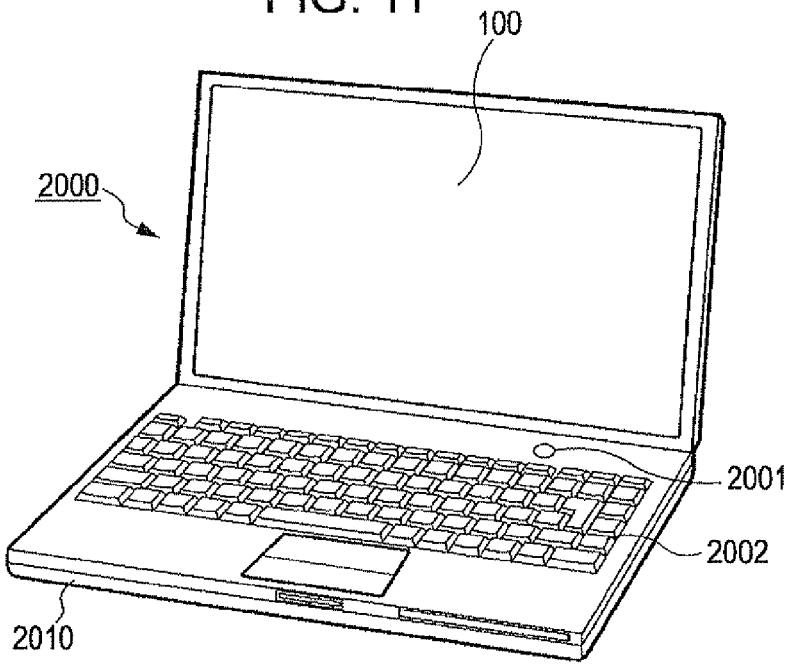
FIG. 11 is a perspective view of an electronic device in which the organic EL device according to an aspect of the invention has been applied.

FIG. 11 is a perspective view illustrating the configuration of a mobile personal computer that includes the organic EL device 100 according to the above embodiment in its image display device. A personal computer 2000 includes the organic EL device 100 serving as its display device, and a main body portion 2010. The main body portion 2010 is provided with a power switch 2001 and a keyboard 2002.

Figure 12:
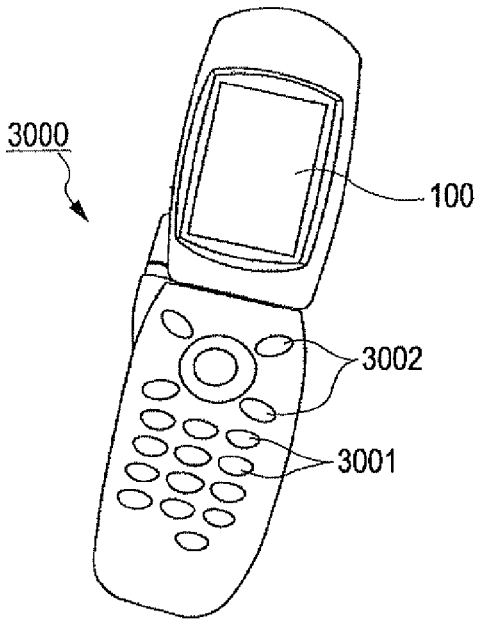
FIG. 12 is a perspective view of another electronic device in which the organic EL device according to an aspect of the invention has been applied.

FIG. 12 illustrates a mobile telephone device in which the organic EL device 100 according to the above embodiment has been applied. A mobile telephone device 3000 includes multiple operational buttons 3001, a scroll button 3002, and the organic EL device 100 serving as a display device. The screen displayed in the organic EL device 100 is scrolled through the operation of the scroll button 3002.

Figure 13:
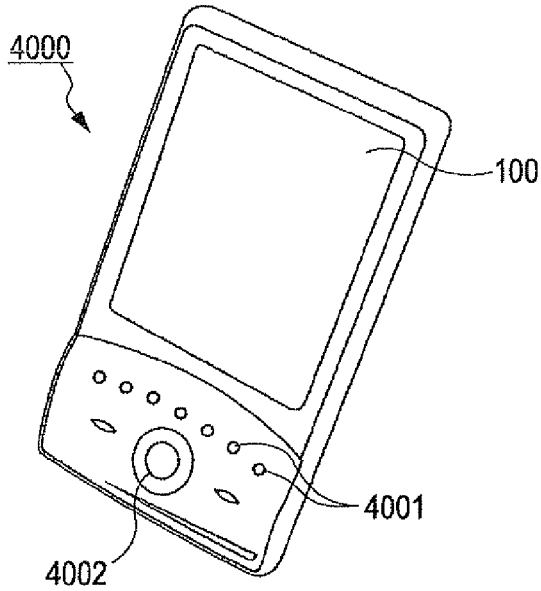
FIG. 13 is a perspective view of yet another electronic device in which the organic EL device according to an aspect of the invention has been applied.

FIG. 13 illustrates a Personal Digital Assistant (PDA) in which the organic EL device 100 according to the above embodiment has been applied. A Personal Digital Assistant 4000 includes multiple operational buttons 4001, a power switch 4002, and the organic EL device 100 serving as a display device. When the power switch 4002 is operated, various information such as address records, a schedule book, and so on is displayed in the organic EL device 100.

Examples of electronic devices in which the organic EL device according to the invention can be applied include digital still cameras, televisions, video cameras, car navigation systems, pagers, electronic notebooks, electronic paper, calculators, word processors, workstations, video phones, POS terminals, video players, devices provided with touch panels, and so on, in addition to the electronic devices illustrated in FIGS. 11 through 13.

What is claimed is:

1. A light-emitting device comprising:

a light-emitting element that emits light based on a magnitude of a driving current;

a driving transistor, a gate thereof being electrically connected to a first node, that outputs a current flowing between a drain and a source as the driving current;

and a control unit that supplies a first data potential to the first node and supplies a current to the driving transistor so as to set a voltage between the gate and the source of the driving transistor to a compensated voltage based on a mobility of the driving transistor, and then supplies a second data potential to correct the compensated voltage that varies based on differences in values of the first data potential to the first node.

2. The light-emitting device according to claim 1, further comprising:

an emission control switching element, one end thereof being electrically connected to the drain of the driving transistor and the other end thereof being electrically connected to a source potential supply line, that switches between conductive and nonconductive states, the emission control switching element being set by the control unit to an OFF state when the second data potential is supplied to the first node.

3. The light-emitting device according to claim 1, further comprising:

a capacitance element, two electrodes thereof being electrically connected to the gate and source, respectively, of the driving transistor, that holds the compensated voltage;

a first switching element that switches between conductive and nonconductive states between the first node and a supply line of the first and second data potentials;

a second switching element that switches between conductive and nonconductive states between the first node and a supply line of a first predetermined fixed potential; and a third switching element that switches between conductive and nonconductive states between the source of the driving transistor and the supply line of a second predetermined fixed potential.

4. The light-emitting device according to claim 1, further comprising:

multiple light-emitting elements and multiple driving transistors, each of the multiple driving transistors corresponding respectively to each of the multiple light-emitting elements, a degree of variance in the mobilities of the multiple driving transistors being used to determine the first data potential and the second data potential.

5. The light-emitting device according to claim 1, further comprising:

a data table in which the second data potential, based on differences in the first data potential, is stored in advance.

6. An electronic device comprising the light-emitting device according to claim 1.

7. A method for driving a light-emitting device including a light-emitting element that emits light of an amount based on a size of a driving current, the method comprising:

supplying a first data potential to a first node connected to a gate of a driving transistor that outputs the driving current and supplying a current to the driving transistor so as to set a voltage between the gate and a source of the driving transistor to a compensated voltage based on a mobility of the driving transistor; and supplying a second data potential to correct the compensated voltage that varies based on differences in values of the first data potential to the first node after the supplying of the first potential.

8. The method according to claim 7, the light-emitting device further including an emission control switching element, one end thereof being electrically connected to a drain of the driving transistor and the other end thereof being electrically connected to a source potential supply line, that switches between conductive and nonconductive states therebetween, the supplying of the second data potential further comprising:

setting the emission control switching element to an OFF state.

9. The method according to claim 7, the light-emitting device further including multiple light-emitting elements and multiple driving transistors, each of the multiple driving transistors corresponding respectively to each of the multiple light-emitting elements, the method further comprising:

determining the first data potential and the second data potential based on a degree of variance in the mobilities of the multiple driving transistors.

* * * * *